US007592993B2

(12) United States Patent
Kim

(10) Patent No.: US 7,592,993 B2
(45) Date of Patent: Sep. 22, 2009

(54) SOURCE DRIVER CAPABLE OF CONTROLLING SOURCE LINE DRIVING SIGNALS IN A LIQUID CRYSTAL DISPLAY DEVICE

(75) Inventor: Ki-Joon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 629 days.

(21) Appl. No.: 11/255,834

(22) Filed: Oct. 21, 2005

(65) Prior Publication Data

US 2006/0089101 A1 Apr. 27, 2006

(30) Foreign Application Priority Data

Oct. 23, 2004 (KR) ..... 10-2004-0085091

(51) Int. Cl.
*G09G 3/36* (2006.01)

(52) U.S. Cl. ..... 345/98; 345/99

(58) Field of Classification Search ..... 345/99, 345/87, 98

See application file for complete search history.

(56) References Cited

U.S. PATENT DOCUMENTS 6,201,535 B1 * 3/2001 Hwang ..... 345/213
7,432,904 B2 * 10/2008 Kang ..... 345/98
2002/0067331 A1 * 6/2002 Takabayashi et al. ..... 345/99
2003/0052851 A1 * 3/2003 Yano et al. ..... 345/89
2003/0234758 A1 * 12/2003 Bu et al. ..... 345/90
2004/0239602 A1 * 12/2004 Kim et al. ..... 345/87
2004/0263466 A1 * 12/2004 Song et al. ..... 345/100
2005/0264548 A1 * 12/2005 Okamura et al. ..... 345/204
2007/0182667 A1 * 8/2007 Choi ..... 345/55
2007/0290983 A1 * 12/2007 Kim et al. ..... 345/100
2008/0007545 A1 * 1/2008 Chang et al. ..... 345/211

FOREIGN PATENT DOCUMENTS

JP 7181926 7/1995
JP 7239675 9/1995
JP 10142573 5/1998
JP 2002182605 6/2002

* cited by examiner

*Primary Examiner*—Amare Mengistu
*Assistant Examiner*—Koosha Sharifi
(74) *Attorney, Agent, or Firm*—F. Chau & Associates, LLC

(57) ABSTRACT

There is provided a source driver capable of controlling the timing of source line driving signals in a liquid crystal display device. The source driver includes a plurality of output circuits, each output circuit including an output buffer and a switch. The output buffer amplifies an analog image signal, and the switch outputs the amplified analog image signal as a source line driving signal in response to a control signal. The source driver further comprises a control circuit for generating the control signal, the control circuit comprising: a delay circuit delaying a switch signal and generating a delayed switch signal; and a multiplexer selecting one of the switch signal and the delayed switch signal in response to a selection signal and outputting the selected signal as the control signal.

10 Claims, 6 Drawing Sheets

SOURCE DRIVER CAPABLE OF CONTROLLING SOURCE LINE DRIVING SIGNALS IN A LIQUID CRYSTAL DISPLAY DEVICE

CROSS-REFERENCE TO RELATED APPLICATION

This application claims priority to Korean Patent Application No. 10-2004-0085091, filed on Oct. 23, 2004, in the Korean Intellectual Property Office, the disclosure of which is incorporated herein by reference in its entirety.

TECHNICAL FIELD

The present invention relates to a thin film transistor liquid crystal display device, and more particularly, to a source driver capable of controlling the timing of source line driving signals in a liquid crystal display device.

DISCUSSION OF THE RELATED ART

Liquid crystal display devices are typically used in notebook computers, desktop computer monitors and televisions, etc. Generally, a liquid crystal display device includes a gate driver for driving gate lines of a panel and a source driver for driving source lines of the panel.

FIG. 1 is a block diagram of a conventional line driver 10, which drives a source line, and includes a level shifter 12, a digital-to-analog converter (DAC) 14, an output buffer 16, and a switch 18.

The level shifter 12 raises the voltage level of a digital image signal D_DATA and the DAC 14 converts a digital image signal output from the level shifter 12 to an analog image signal IN. The analog image signal IN has a gray level voltage and is also called an RGB data signal.

The output buffer 16 amplifies the analog image signal IN and the switch 18 outputs the amplified analog image signal IN as a source line driving signal OUT in response to the activation of a control signal SW. The output buffer 16 and the switch 18 constitute an output circuit.

FIG. 2 is a circuit diagram of a conventional source driver 100 including a plurality of output circuits 111 through 11n, where n is an integer greater than 2. The output circuit shown in FIG. 1 has the same or similar structure as each of the output circuits 111 through 11n.

Referring to FIG. 2, the first output circuit 111 includes a first output buffer B1 and a first transmission gate or switch S1. The first output buffer B1 can be implemented by an operational amplifier with a voltage follower structure. The first output buffer B1 amplifies a first analog image signal IN1 and outputs a first internal image signal INT1. The first transmission gate S1 outputs the first internal image signal INT1 as a first source line driving signal OUT1 in response to the activation of a control signal SW and the activation of an inverted control signal SWB. The first source line driving signal OUT1 drives a first source line of a panel of a liquid crystal display device.

Each of second through n-th output circuits 112 through 11n includes the same or similar components as the first output circuit 111, and therefore detailed descriptions thereof are omitted.

FIG. 3 is an exemplary timing diagram of various signals of the first output circuit 111.

Referring to FIG. 3, the first internal image signal INT1 and the first source line driving signal OUT1 change by going to a high level or a low level with respect to a common voltage VCOM. The common voltage VCOM is a voltage applied to a terminal of a liquid crystal capacitor included in a pixel of the panel of a liquid crystal display device. The common voltage VCOM may be VDD/2, where VDD is a power supply voltage.

When the first internal image signal INT1 transitions from a high level (for example, the power supply voltage VDD) to a low level (for example, a ground voltage VSS) or from the low level VSS to the high level VDD, the control signal SW is activated to a high level. Then, the first source line driving signal OUT1 is generated. Accordingly, the timing of the first source line driving signal OUT1 depends on the activation time of the control signal SW. Likewise, the timing of second through n-th source line driving signals OUT2 through OUTn depend on the activation time of the control signal SW when it is applied to the transmission gates S2 through Sn.

FIG. 4 is a timing diagram showing various timing relationships D0 through D7 of the first through n-th source line driving signals OUT1 through OUTn.

As shown in FIG. 4, when the source line driving signals OUT1 through OUTn have the timing relationship shown by D0 they are equal. When the source line driving signals OUT1 through OUTn have the timing relationship shown by D1 they increase sequentially and when the source line driving signals OUT1 through OUTn have the timing relationships shown by D2 through D7 they fluctuate by going to a high level or a low level.

Due to variations and tolerances of the materials and manufacture of a chip embodying a source driver, offsets can occur between the timing of the source line driving signals OUT1 through OUTn in the source driver chip and between source driver chips. As a result, such offsets render unstable operation of a liquid crystal display device. A need therefore exists for a source driver capable of controlling the timing of source line driving signals in a liquid crystal display device.

SUMMARY OF THE INVENTION

According to an aspect of the present invention, there is provided a source driver of a liquid crystal display device, including a plurality of output circuits, each of the output circuits comprising: an output buffer amplifying an analog image signal; and a switch outputting the amplified analog image signal as a source line driving signal whose timing is controlled, in response to the activation of a control signal.

The source driver further includes a control circuit generating the control signal, wherein the control circuit comprises: at least one delay circuit delaying a switch signal by a predetermined amount of time and generating a delayed switch signal; a multiplexer selecting one of the switch signal and the delayed switch signal in response to a selection signal and outputting the selected signal as the control signal; and an inverter inverting the control signal and generating an inverted signal of the control signal.

The predetermined amount of time is less than a predetermined value so that the source line driving signal is output by the control signal and the inverted signal of the control signal.

The switch is a transmission gate operating in response to the activation of the control signal and the activation of an inverted signal of the control signal, and the output buffer is an operational amplifier with a voltage follower structure.

According to another aspect of the present invention, there is provided a source driver of a liquid crystal display device, comprising: output circuit blocks, each including at least two output circuits, outputting source line driving signals; and control circuits generating control signals controlling timings of the source line driving signals.

Each of the output circuits comprises: an output buffer amplifying an analog image signal; and a switch outputting the amplified analog image signal as the source line driving signal in response to the activation of the control signal.

Each of the control circuits comprises: at least one delay circuit delaying a switch signal by a predetermined amount of time and generating a delayed switch signal; a multiplexer selecting one of the switch signal and the delayed switch signal in response to a selection signal and outputting the selected signal as the control signal; and an inverter inverting the control signal and generating an inverted signal of the control signal.

According to another aspect of the present invention, a method for controlling a source line driving signal in a liquid crystal display device is provided. The method comprises: amplifying, from an output buffer of a source driver, an analog image signal; delaying, at a first delay circuit of a control circuit of the source driver, a switch signal and generating, at the first delay circuit, a delayed switch signal; selecting, at a multiplexer of the control circuit, one of the switch signal and the delayed switch signal in response to a selection signal and outputting, at the multiplexer, the selected signal as a control signal; and outputting, from a switch of the source driver, the amplified analog image signal as the source line driving signal in response to the control signal.

The analog image signal is generated by a level shifter and a digital to analog converter of the liquid crystal display device. The switch signal is delayed by a first amount of time that is less than a first value so that the source line driving signal is output by the control signal and the inverted control signal. The selection signal is received through a timing controller of the liquid crystal display device or through option pins of the source driver. The delay of the switch signal sequentially increases from the first delay circuit to a second delay circuit.

BRIEF DESCRIPTION OF THE DRAWINGS

The above and other features of the present invention will become more apparent by describing in detail exemplary embodiments thereof with reference to the attached drawings in which.

DETAILED DESCRIPTION OF EXEMPLARY EMBODIMENTS

Hereinafter, embodiments of the present invention will be described in detail with reference to the appended drawings. Like reference numbers refer to like components throughout the drawings.

Figure 5:
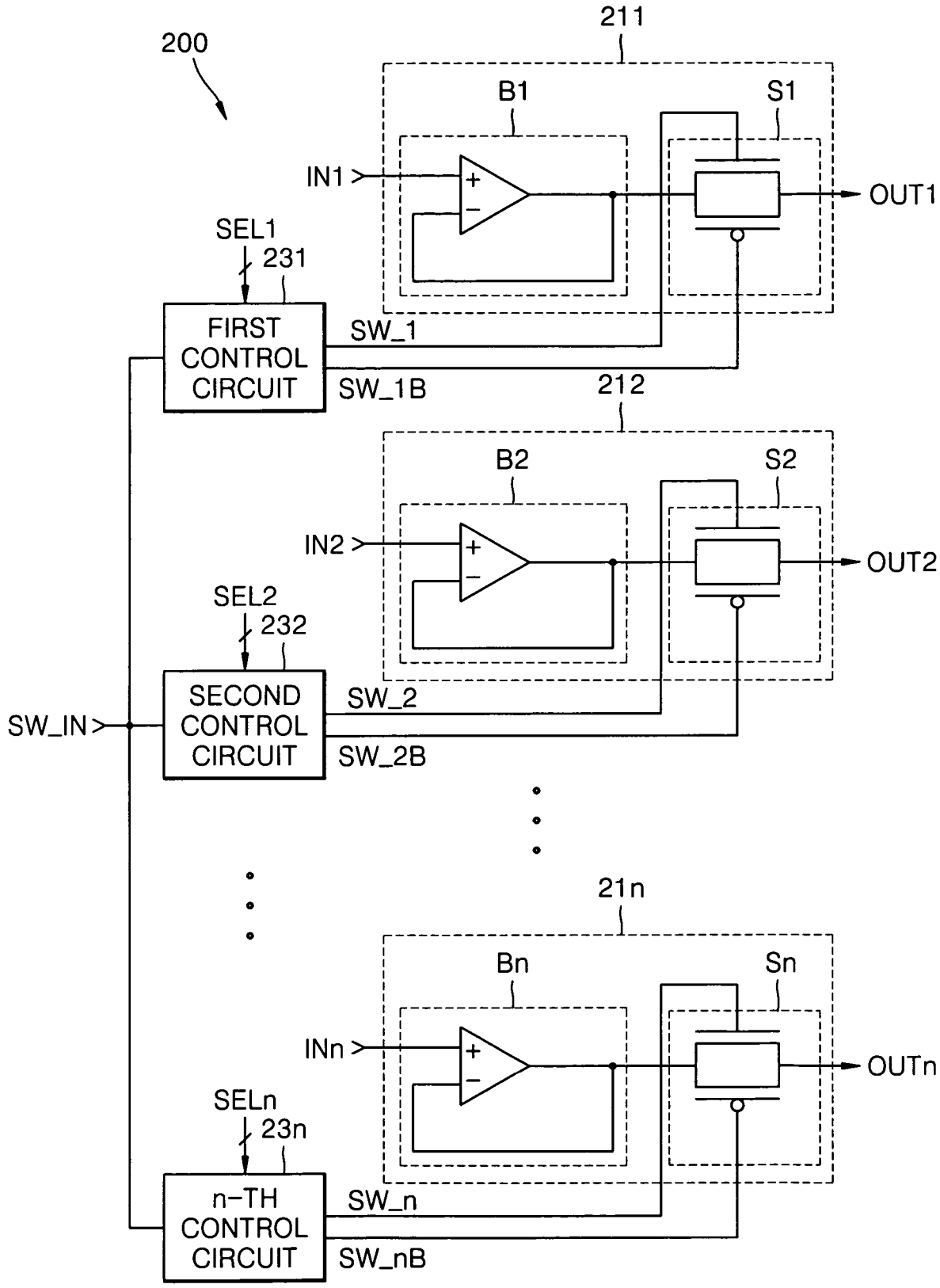
FIG. 5 is a schematic diagram of a source driver of a liquid crystal display device according to an exemplary embodiment of the present invention.

FIG. 5 is a schematic diagram of a source driver 200 of a liquid crystal display device according to an embodiment of the present invention.

Referring to FIG. 5, the source driver 200 includes first through n-th output circuits 211 through 21n and first through n-th control circuits 231 through 23n for controlling the timings of the output circuits 211 through 21n. Here, n is an integer greater than 2.

The first output circuit 211 includes a first output buffer B1 and a first switch S1. The first output buffer B1 can be implemented by an operational amplifier with a voltage follower structure, and the first switch S1 can be implemented by a transmission gate operating in response to a first control signal SW_1 and an inverted first control signal SW_1B.

Figure 1:
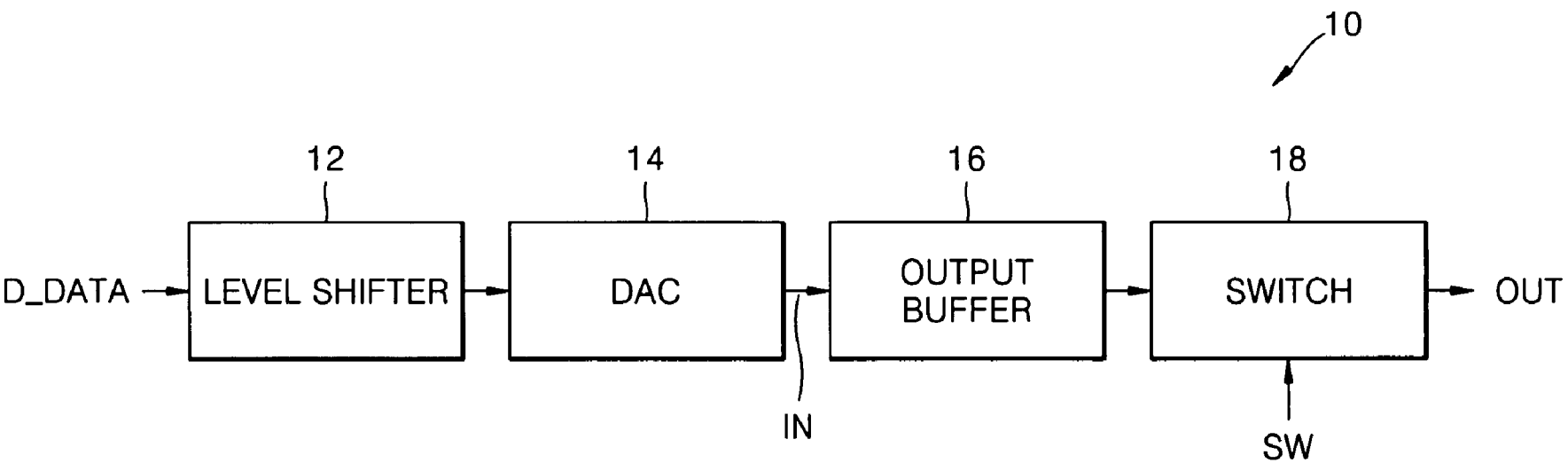
FIG. 1 (PRIOR ART)
FIG. 1 is a block diagram of a line driver included in a conventional source driver.
Figure 2:
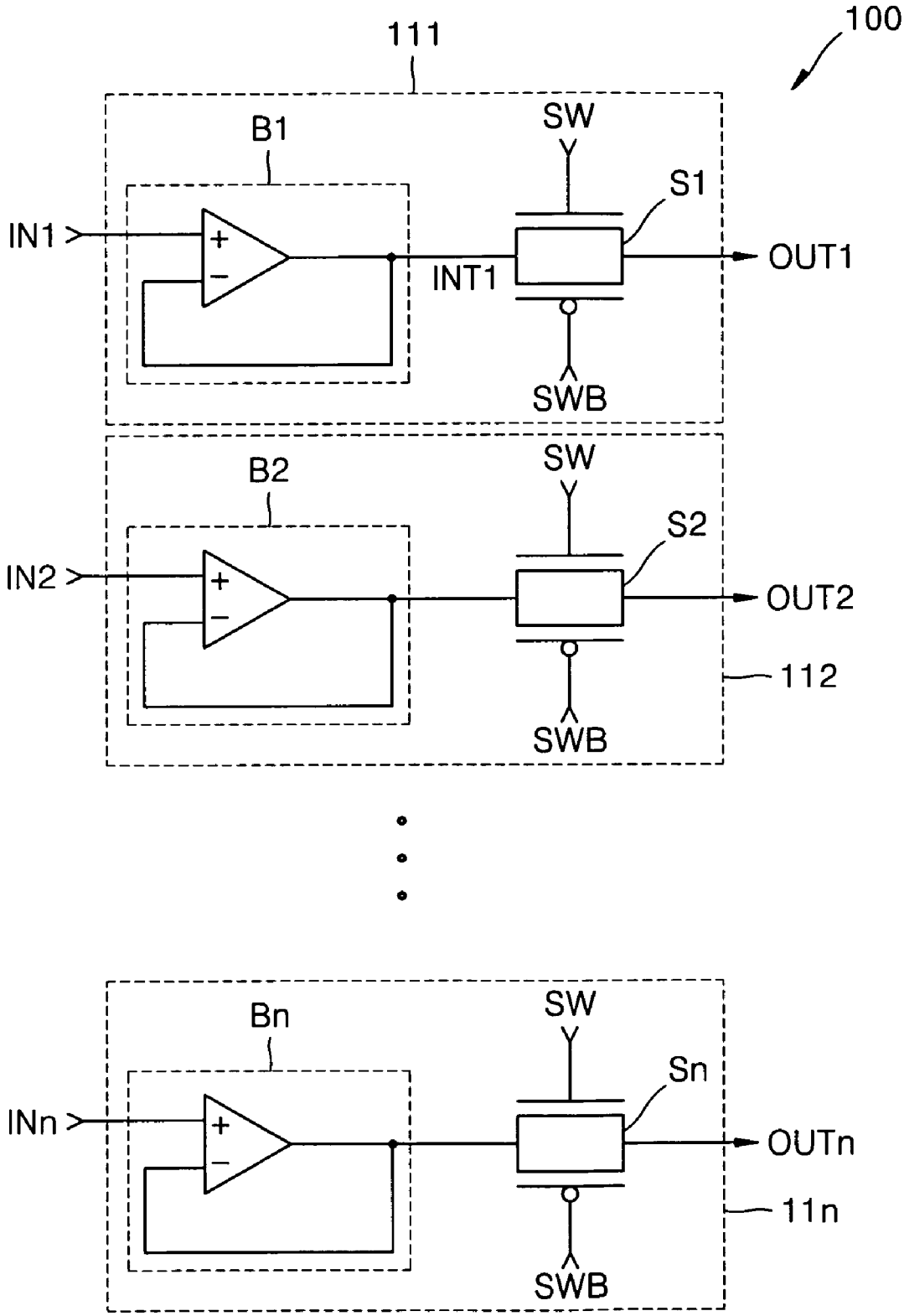
FIG. 2 (PRIOR ART)
FIG. 2 is a circuit diagram of a conventional source driver including a plurality of output circuits.
Figure 3:
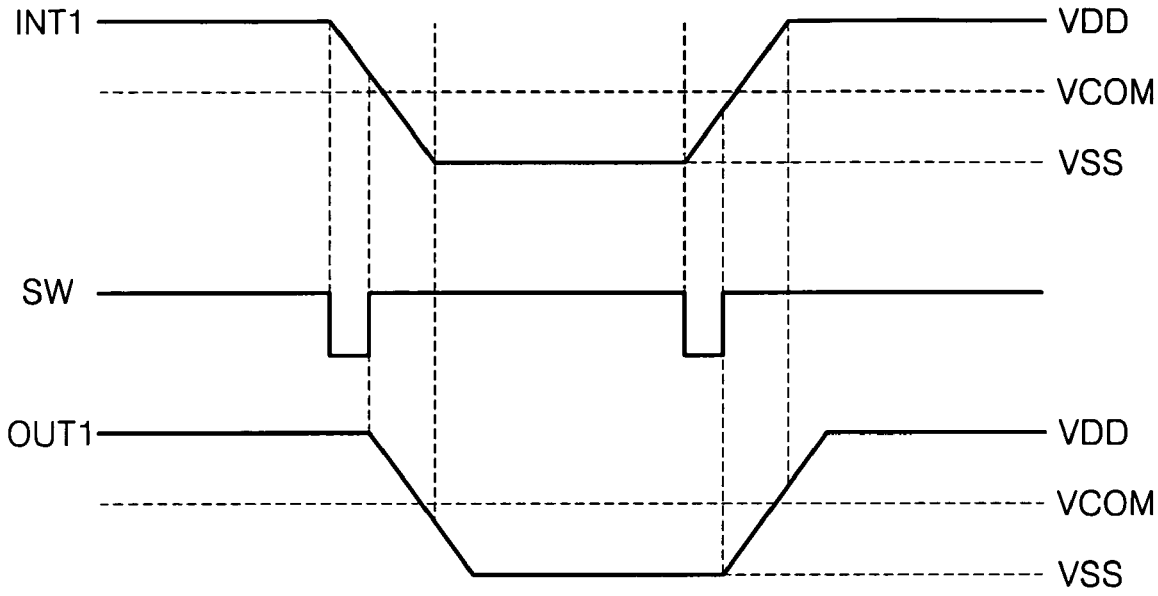
FIG. 3 (PRIOR ART)
FIG. 3 is an exemplary timing diagram of a first output circuit shown in FIG. 2.
Figure 4:
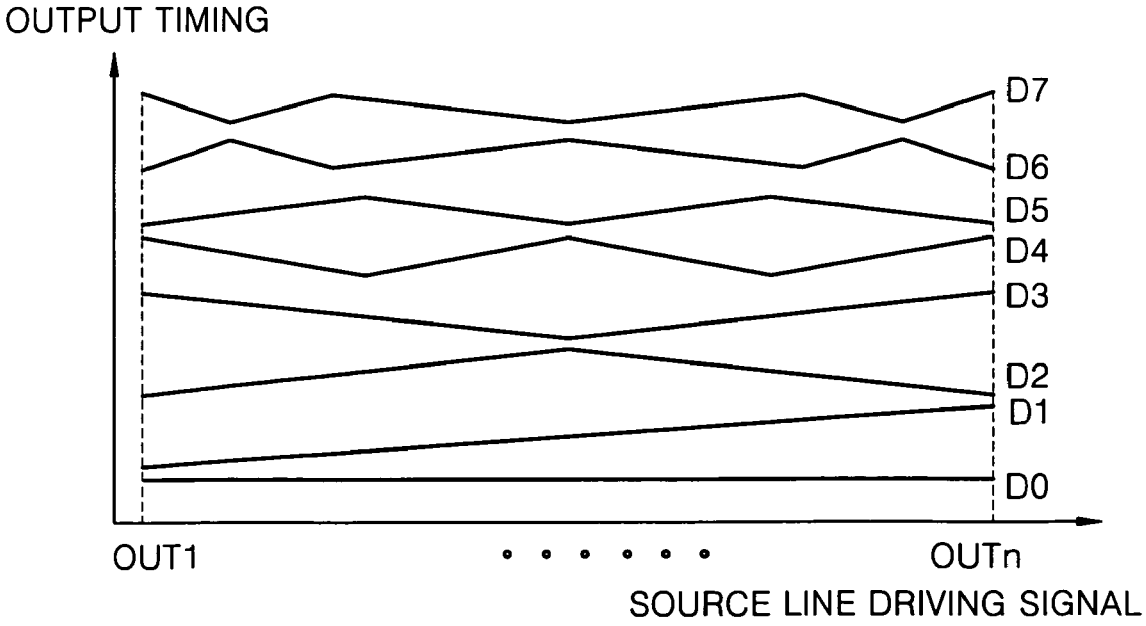
FIG. 4 (PRIOR ART)
FIG. 4 is a timing diagram showing various timing relationships of source line driving signals shown in FIG. 2.

The first output buffer B1 amplifies a first analog image signal IN1 generated by the level shifter 12 and the DAC 14 shown in FIG. 1. The first switch S1 outputs the amplified analog image signal IN1 as a first source line driving signal OUT1 in response to the activation of the first control signal SW_1 and the activation of the inverted first control signal SW_1B. In other words, the first switch S1 controls the timing of the first source line driving signal OUT1.

The first control circuit 231 delays a switch signal SW_IN, generates a plurality of delayed switch signals, selects one of the switch signal SW_IN and the delayed switch signals in response to a first selection signal SEL1, and outputs the selected signal as the first control signal SW_1 and outputs the inverted first control signal SW_1B. The switch signal SW_IN is generated by the source driver 200, and the first selection signal SEL1, which consists of a plurality of bits, and can be received through a timing controller of the liquid crystal display device or through option pins of a source driver chip.

Second through n-th output circuits 212 through 21n include the same or similar components [B2, S2] through [Bn, Sn] as the first output circuit 211. In addition, second through n-th control circuits 232 through 23n for controlling the timings of the second through n-th output circuits 212 through 21n perform the same or similar functions as the first control circuit 231. Accordingly, detailed descriptions of the second through n-th output circuits 212 through 21n and the second through n-th control circuits 232 through 23n are omitted.

Referring to FIG. 5, input signals of the second through n-th output circuits 212 through 21n are second through n-th analog image signals IN2 through INn and output signals of the second through n-th output circuits 212 through 21n are second through n-th source line driving signals OUT2 through OUTn. Control signals of the second through n-th control circuits 232 through 23n are second through n-th selection signals SEL2 through SELn and output signals of the second through n-th control circuits 232 through 23n are second through n-th control signals SW_2 through SW_n and inverted control signals SW_2B through SW_nB.

Figure 6:
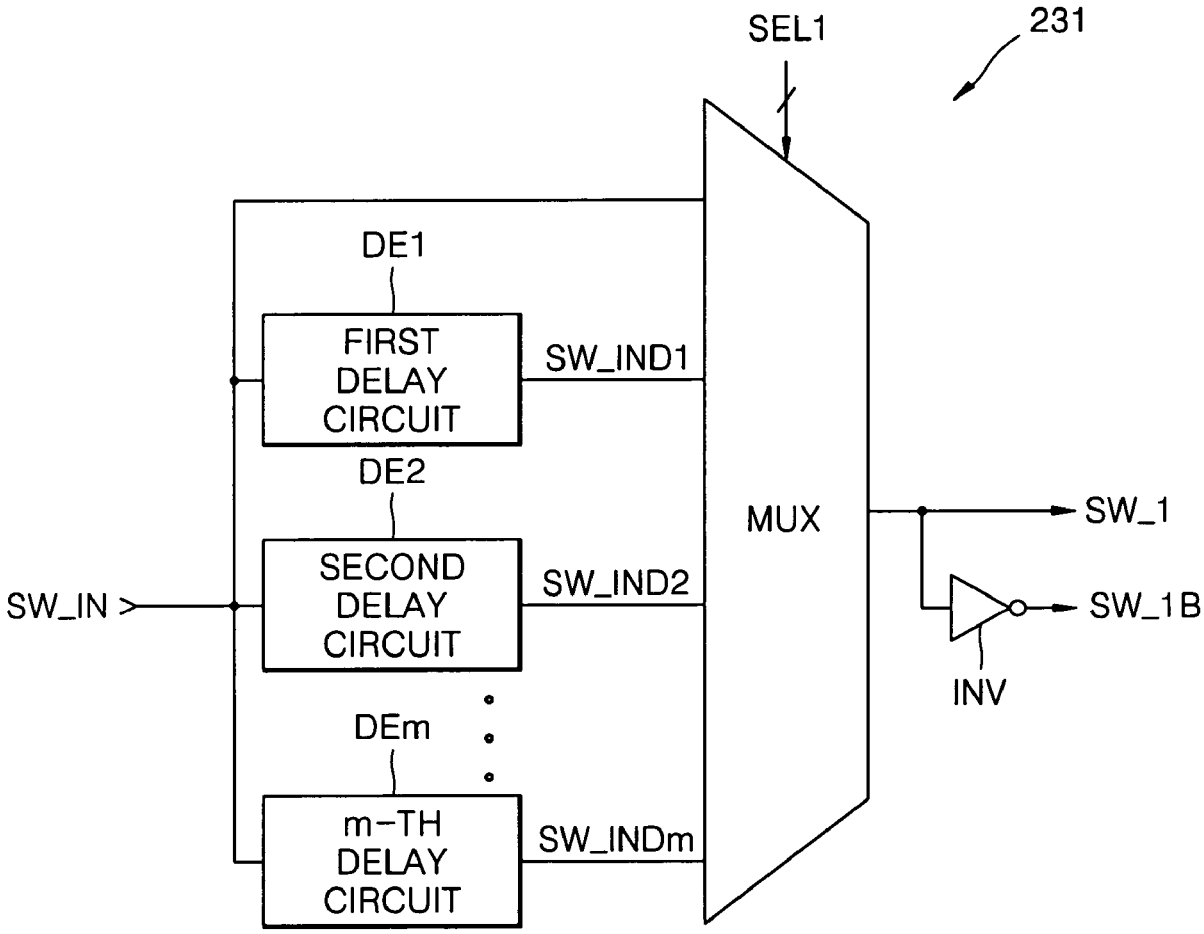
FIG. 6 is a block diagram of a first control circuit shown in FIG. 5.

FIG. 6 is a block diagram of the first control circuit 231 shown in FIG. 5.

Referring to FIG. 6, the first control circuit 231 includes first through m-th delay circuits DE1 through DEm, a multiplexer MUX, and an inverter INV.

The first through m-th delay circuits DE1 through DEm delay the switch signal SW_IN by a predetermined number of times and output delayed switch signals SW_IND1 through SW_INDm, respectively. Here, m is an integer greater than 2, which may be set according to the size of a source driver chip.

The delays of the first through m-th circuits DE1 through DEm can sequentially increase. The delays of the first through m-th delay circuits DE1 through DEm are set below a predetermined value so that the first source line driving signal OUT1 can be output in response to the first control signal SW_1 and the inverted first control signal SW_1B.

The multiplexer MUX selects one of the switch signal SW_IN and the delayed switch signals SW_IND1 through SW_INDm in response to the first selection signal SEL1 and outputs the selected signal as a control signal SW1.

The inverter INV inverts the first control signal SW_1 and generates the inverted first control signal SW_1B.

Each of the second through n-th control circuits 232 through 23n includes the same or similar components as the first control circuit 231.

Figure 7:
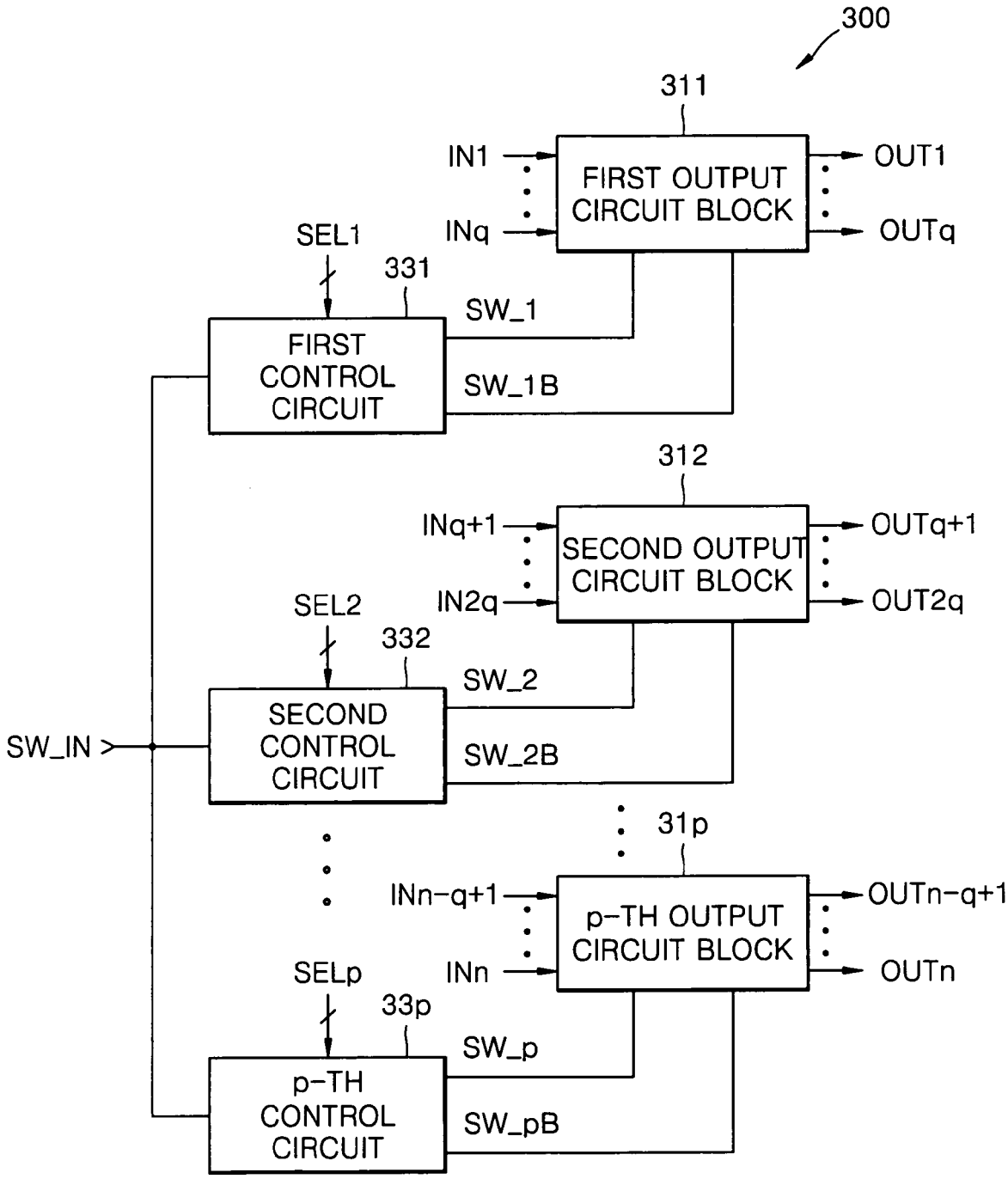
FIG. 7 is a block diagram of a source driver according to another exemplary embodiment of the present invention.

FIG. 7 is a block diagram of a source driver 300 according to another embodiment of the present invention.

Referring to FIG. 7, the source driver 300 includes first through p-th output circuit blocks 311 through 31p and first through p-th control circuits 331 through 33p for controlling the timings of the first through p-th output circuit blocks 311 through 31p. Each of the output circuit blocks 311 through 31p includes q of the output circuits 211 through 21n shown in FIG. 5. Here, n, p, and q are integers greater than 2, and p and q are less than n.

Each of the q output circuits included in the first output circuit block 311 includes the same or similar components as the output circuits 211 through 21n. The first output circuit block 311 amplifies first block analog image signals IN1 through INq and outputs the amplified block analog image signals IN1 through INq as first block source line driving signals OUT1 through OUTq in response to the activation of a first control signal SW_1 and the activation of an inverted first control signal SW_1B.

The first control circuit 331 includes the same or similar components as the first control circuit 231 shown in FIG. 6. The first control circuit 331 delays a switch signal SW_IN, generates a plurality of delayed switch signals, selects one of the switch signal SW_IN and the delayed switch signals in response to a first selection signal SEL1, and outputs the selected signal as the first control signal SW_1 and outputs the inverted first control signal SW_1B. The switch signals SW_IN are generated by the source driver 300. The first selection signal SEL1, which consists of a plurality of bits, can be received through option pins of a source driver chip or through a timing controller of a liquid crystal display device including the source driver 300.

Each of the second through p-th output circuit blocks 312 through 31p includes the same or similar components as the first output circuit block 311, and each of the second through p-th control circuits 332 through 33p for controlling the second through p-th output circuit blocks 312 through 31p performs the same or similar functions as the first control block 331. Accordingly, detailed descriptions of the second through p-th output circuit blocks 312 through 31p and the second through p-th control circuits 332 through 33p are omitted.

Referring to FIG. 7, input signals of the second through p-th output circuit blocks 312 through 31p are second through p-th block analog image signals [INq+1 through IN2q] through [INn−q+1 through INn], and output signals of the second through p-th output circuits 312 through 31p are second through p-th block source line driving signals [OUTq+1 through OUT2q] through [OUTn−q+1 through OUTn]. Control signals of the second through p-th control circuits 332 through 33p are second through p-th selection signals SEL2 through SELp, and output signals of the second through p-th control circuits 332 through 33p are second through p-th control signals SW_2 through SW_p and inverted control signals SW_2B through SW_pB.

According to an embodiment of the present invention, a source driver that controls the delay times of control signals for controlling switches of output circuits, thereby controlling the timings of source line driving signals is disclosed.

While the present invention has been shown and described with reference to exemplary embodiments thereof, it will be understood by those of ordinary skill in the art that various changes in form and details may be made therein without departing from the spirit and scope of the present invention as defined by the following claims.

What is claimed is:

1. A source driver of a liquid crystal display device, comprising:

a plurality of output circuits; and a plurality of control circuits, wherein each of the output circuits comprises:

an output buffer amplifying an analog image signal; and a switch outputting the amplified analog image signal as a source line driving signal in response to a control signal, and wherein each of the control circuits comprises:

a plurality of delay circuits, each of the delay circuits delaying a switch signal and generating a delayed switch signal; and a multiplexer selecting the switch signal or one of the delayed switch signals in response to a selection signal and outputting the selected signal as the control signal, wherein each of the delay circuits directly receives the switch signal and holds the switch signal for an amount of time that is different than that of another delay circuit so that the delayed switch signals have different delay times.

2. The source driver of claim 1, wherein the switch signal is held for a first amount of time that is less than a first value so that the source line driving signal is output in response to the control signal and an inverted control signal.

3. The source driver of claim 2, wherein the selection signal comprises a plurality of bits and is received through a timing controller of the liquid crystal display device or through option pins of the source driver.

4. The source driver of claim 1, wherein the switch is a transmission gate operating in response to the control signal and the inverted control signal.

5. The source driver of claim 1, wherein the output buffer is an operational amplifier with a voltage follower structure.

6. A method for controlling a source line driving signal in a liquid crystal display device, comprising:

receiving and amplifying an analog image signal at an output buffer of an output circuit of a source driver;

receiving a switch signal at a control circuit of the source driver;

providing the switch signal to a multiplexer and a plurality of delay circuits in the control circuit, wherein each delay circuit directly receives the switch signal and holds the switch signal for an amount of time that is different than that of another delay circuit so that the delay circuits can generate delayed switch signals that have different delay times;

selecting, at the multiplexer, the switch signal or one of the delayed switch signals in response to a selection signal and outputting the selected signal as a control signal; and outputting, from a switch in the output circuit, the amplified analog image signal as a source line driving signal in response to the control signal.

7. The method of claim 6, wherein the analog image signal is generated by a level shifter and a digital to analog converter of the liquid crystal display device.

8. The method of claim 6, wherein the switch signal is held for a first amount of time that is less than a first value so that the source line driving signal is output by the control signal and the inverted control signal.

9. The method of claim 8, wherein the selection signal is received through a timing controller of the liquid crystal display device or trough option pins of the source driver.

10. The method of claim 6, wherein the delay time of the switch signal sequentially increases from one delay circuit to another delay circuit.

* * * * *